US007082900B2

(12) United States Patent
Tawa et al.

(10) Patent No.: US 7,082,900 B2
(45) Date of Patent: Aug. 1, 2006

(54) OUTBOARD ENGINE SYSTEM

(75) Inventors: Hiroki Tawa, Saitama (JP); Yoshihiko Fukuda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 16 days.

(21) Appl. No.: 10/873,653

(22) Filed: Jun. 23, 2004

(65) Prior Publication Data

US 2005/0011475 A1 Jan. 20, 2005

(30) Foreign Application Priority Data

Jun. 25, 2003 (JP) ..... 2003-180969

(51) Int. Cl.
*F01P 7/14* (2006.01)

(52) U.S. Cl. ..... 123/41.08; 123/41.67

(58) Field of Classification Search ..... 123/41.08, 123/41.67

See application file for complete search history.

(56) References Cited

U.S. PATENT DOCUMENTS 3,918,418 A * 11/1975 Horn ..... 123/41.08

FOREIGN PATENT DOCUMENTS

| | | |
|---|---|---|
| JP | 50-127028 | 10/1975 |
| JP | 50-127728 | 10/1975 |

* cited by examiner

*Primary Examiner*—Tony M. Argenbright
*Assistant Examiner*—Katrina Harris
(74) *Attorney, Agent, or Firm*—Arent Fox PLLC

(57) ABSTRACT

In an outboard engine system, a first opening communicating with a cooling water discharge passage and a second opening communicating with a cooling water supply passage are formed adjacent to each other in an upper wall of a cooling water passage forming member. A relief valve is provided in a first opening at a position remote from a tilt shaft. The relief valve includes a valve seat provided at the upper wall and facing downward. A valve body is seated on the valve seat from below. Accordingly, any cooling water staying in an upper portion of the relief valve leaks through gaps between the valve seat and the valve body to be discharged easily. When the outboard engine system is tilted upward about the tilt shaft, the opening provided with the relief valve is moved upward so that the cooling water is discharged smoothly through the other opening.

5 Claims, 7 Drawing Sheets

OUTBOARD ENGINE SYSTEM

BACKGROUND OF THE INVENTION

1. Field of the Invention

The present invention relates to an outboard engine system wherein a relief valve is provided at an intermediate portion in a cooling water supply passage to supply cooling water from a cooling water pump to a water jacket.

2. Description of the Related Art

In a conventional outboard engine system, cooling water used to cool an engine is taken in through a cooling water intake port provided at a gear case and supplied by a cooling water pump to a water jacket surrounding a combustion chamber. During this process, the pressure of the cooling water supplied to the water jacket is regulated by a relief valve. The outboard engine systems disclosed by Japanese Utility Model Application Laid-Open Nos. 50-127028 and 50-127728 include relief valves wherein a valve body is seated from above into a valve seat, which is disposed in a horizontal direction and protrudes upward.

The relief valve is closed when the engine of the outboard engine system stops and when the engine operates at a low speed. The relief valve opens when the engine operates at a high speed to restrict the upper limit value of the pressure of the cooling water being supplied to the water jacket. When the engine stops, the relief valve closes, the cooling water in the cooling water discharge passage on the downstream side from the relief valve is discharged as is, and the cooling water in the cooling water supply passage on the upstream side reversely flows through a gap in the impeller of the cooling pump that has been stopped and is discharged.

In the relief valve of the above-described conventional outboard engine systems, the valve seat protrudes upward so the valve body is seated from above. Therefore, when the engine stops and the relief valve closes, it has been observed that cooling water stays in a recessed portion surrounding the valve seat.

Further, because particular attention is not paid to the disposition of the cooling water supply passage and the cooling water discharge passage, which are connected to the relief valve, the cooling water simply stays in the vicinity of the relief valve when the outboard engine system is tilted upward to be landed after the engine stops. Likewise, because salt is deposited in the vicinity of the relief valve, the valve body has to be frequently cleaned, resulting in additional and troublesome maintenance work.

SUMMARY OF THE INVENTION

The present invention has been achieved in view of the aforementioned circumstances. Accordingly, it is an aspect of the present invention to ensure that cooling water does not remain in the vicinity of the relief valve when the engine of the outboard engine system stops.

In order to achieve the above-described aspect, according to a first feature of the present invention, there is provided an outboard engine system in which cooling water is supplied from a cooling water pump through a cooling water supply passage to a water jacket provided around a combustion chamber of an engine. Internal pressure of the cooling water supply passage is regulated by a relief valve, which includes a valve seat having a flange portion mounted to a substantially horizontal upper wall and a cylindrical seat portion protruding downward from the flange portion. A valve body is capable of being seated on the seat portion of the valve seat from below. The valve seat also has a valve spring, which biases the valve body upward toward the valve seat.

With the first feature, the relief valve of the outboard engine system is constructed so that the valve body is biased from below by the valve spring upward toward the valve seat provided at the substantially horizontal upper wall. Therefore, any cooling water remaining in the upper portion of the relief valve, which closes when the engine stops, leaks through small gaps between the valve seat and the valve body. In the valve seat of the relief valve, the cylindrical seat portion protrudes downward from the flange portion mounted to the upper wall. Therefore, it is ensured that the water has difficulty staying between the flange portion and the seat portion compared to the valve seat in the conventional outboard engine systems wherein the cylindrical seat portion protrudes upward from the flange portion.

According to a second feature of the present invention, there is provided an outboard engine system in which cooling water is supplied from a cooling water pump through a cooling water supply passage to a water jacket disposed around a combustion chamber of an engine tiltably mounted around a tilt shaft. The cooling water of the cooling water supply passage is discharged through a relief valve into a cooling water discharge passage, wherein a first opening, communicating with the cooling water discharge passage, and a second opening, communicating with the cooling water supply passage, are formed adjacent to each other in an upper wall of a cooling water passage forming member. A pressure regulating passage is formed by covering upper portions of the first and the second openings with a cover member. The relief valve is provided in one of the first and the second openings, wherein the other opening is disposed at a position closer to a tilt shaft than the one opening having the relief valve.

With the second feature, the pressure regulating passage is formed by covering the upper portions of the adjacently formed first and second openings with the cover member. The relief valve is provided in one of the first and the second openings, wherein the other opening is disposed at a position closer to the tilt shaft than the opening having the relief valve. Therefore, when the outboard engine system is tilted upward around the tilt shaft in a state in which the cooling water stays in the upper portion of the relief valve, which has been closed as the engine stops, the opening having the relief valve is moved upward and the opening not having the relief valve is moved downward. Accordingly, the cooling water is smoothly discharged through the opening not having the relief valve and effectively prevents water from undesirably staying in the vicinity of the relief valve.

In addition to the second feature, according to a third feature of the present invention, at least a part of the relief valve is housed inside the cover member.

With the third feature, at least a part of the relief valve is housed inside the cover member, which forms the pressure regulating passage by covering the upper portions of the first and the second openings of the cooling water passage forming member. Therefore, the cooling water passage forming member is made to be compact and light compared to the case where the pressure regulating passage and the relief valve are housed inside the cooling water passage forming member.

As will be clear from the following discussion, a mount case corresponds to the cooing water passage forming member of the present invention, and a cylinder block cooling water jacket and a cylinder head cooling water jacket correspond to the water jacket of the present invention.

The above-mentioned aspects, characteristics, and advantages of the present invention will become apparent from an explanation of a preferred embodiment, which will be described in detail below by reference to the attached drawings.

DESCRIPTION OF THE PREFERRED EMBODIMENT

Figure 1:
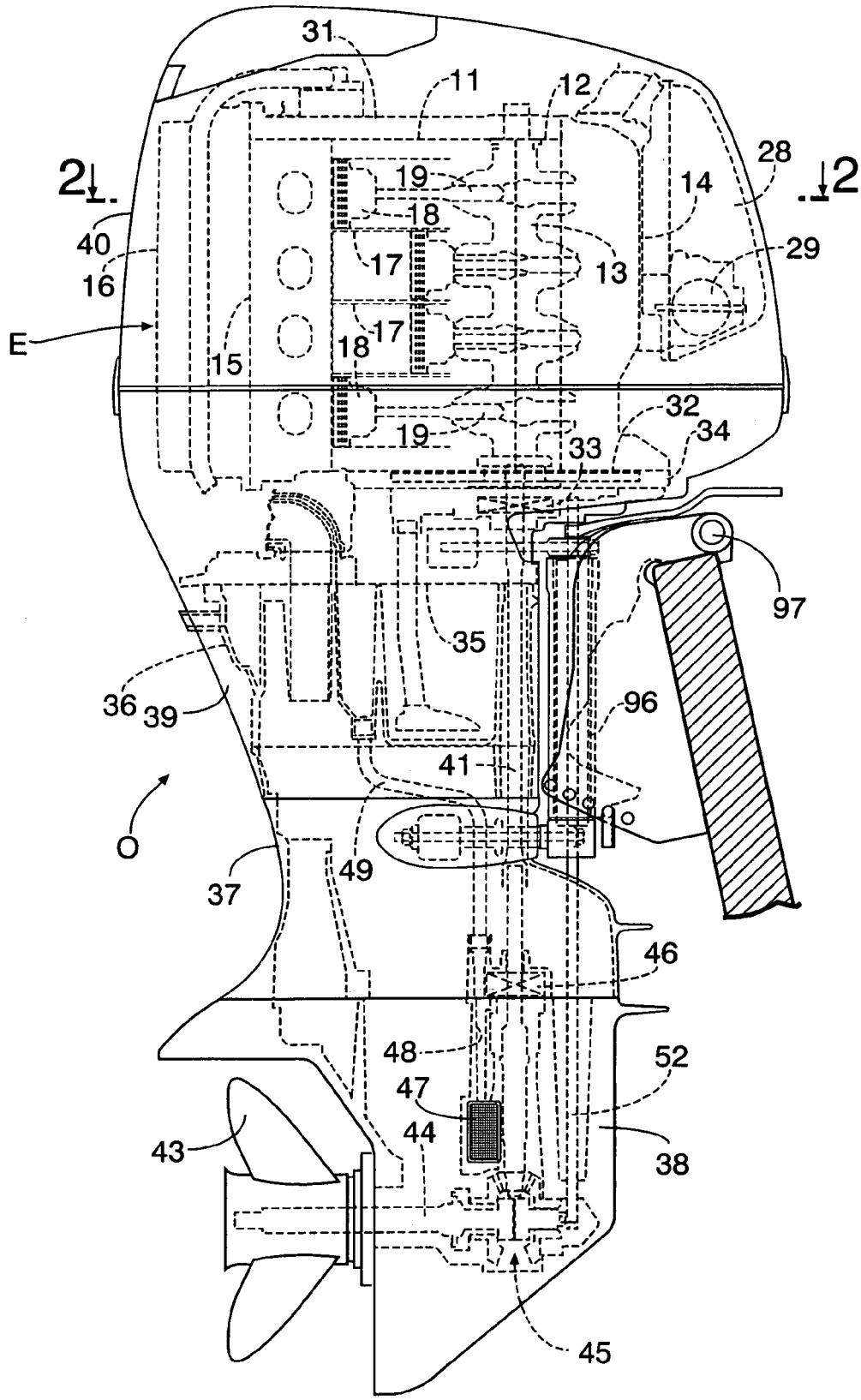
FIG. 1 is a partial cross-sectional side view of an outboard engine system according to an embodiment of the present invention.
Figure 2:
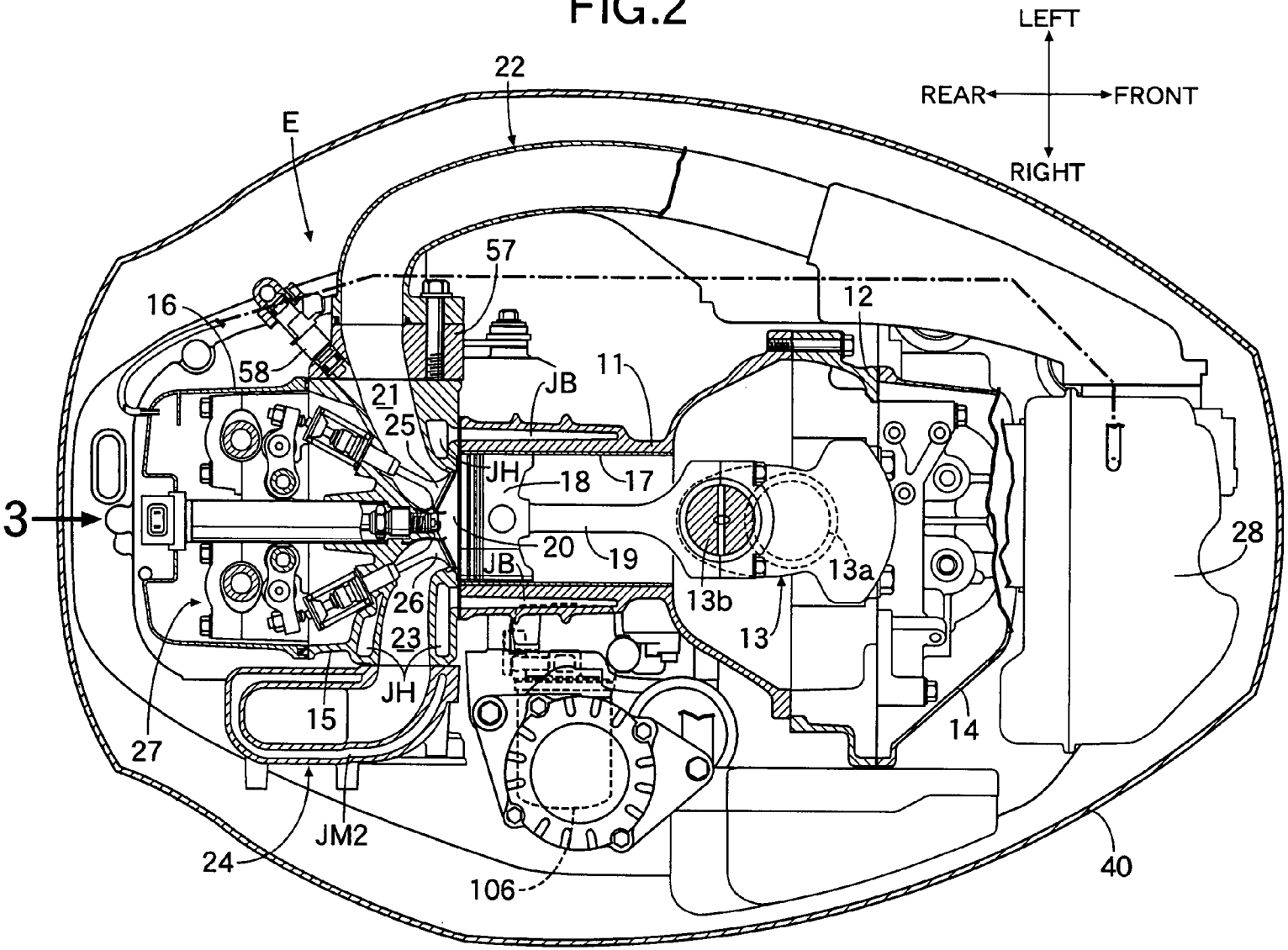
FIG. 2 is an enlarged cross-sectional view taken along line 2—2 in FIG. 1.
Figure 3:
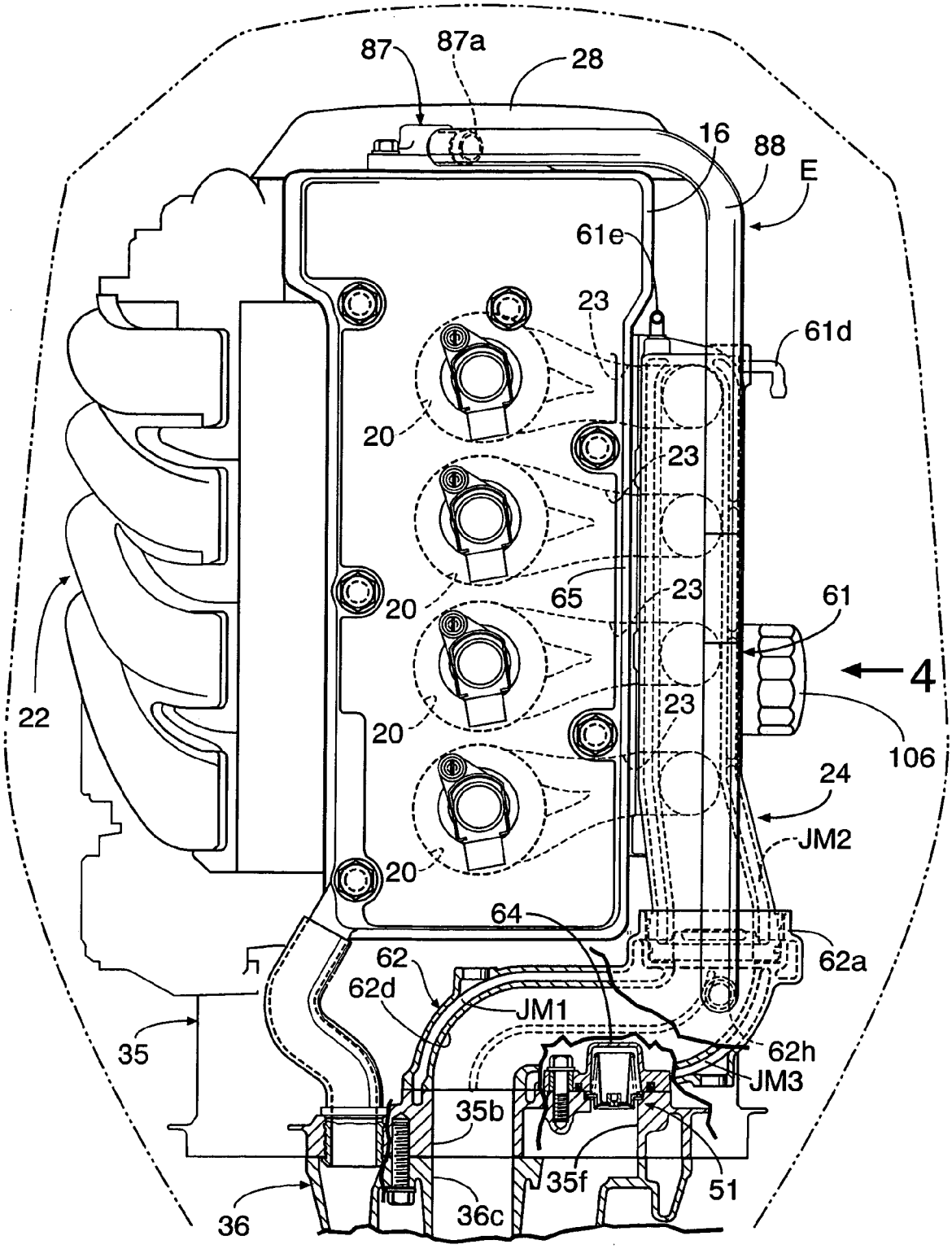
FIG. 3 is a view taken from the direction of arrow 3 in FIG. 2.

As shown in FIG. 1 and FIG. 2, an outboard engine system O is mounted to a body of a boat to steer in a lateral direction about a steering shaft 96, as well as to tilt in a vertical direction about a tilt shaft 97. An in-line four-cylinder four-stroke water-cooling vertical engine E is mounted on an upper portion of the outboard engine system O and includes a cylinder block 11; a lower block 12 connected to a front surface of the cylinder block 11; a crankshaft 13, which is disposed generally vertically and supported so that journals 13*a* are sandwiched between the cylinder block 11 and the lower block 12; a crankcase 14 connected to a front surface of the lower block 12; a cylinder head 15 connected to a rear surface of the cylinder block 11; and a head cover 16 connected to a rear surface of the cylinder head 15. Pistons 18 slidably fitted inside corresponding sleeve-shaped cylinders 17, formed by enveloped-casting in the cylinder block 11, are respectively connected to crank pins 13*b* of the crankshaft 13 via connecting rods 19.

Combustion chambers 20 formed in the cylinder head 15 opposite the top surfaces of the pistons 18 are connected to an intake manifold 22 via intake ports 21 which are open to a left side surface of the cylinder head 15, namely, a port side in a traveling direction of the ship. The combustion chambers 20 are also connected to an exhaust passage 24 inside an engine room via exhaust ports 23 which are open to a right side surface of the cylinder head 15. Intake valves 25 for opening and closing a downstream end of the intake ports 21 and exhaust valves 26 for opening and closing an upstream end of the exhaust ports 23 are driven to open and close by a DOHC-type valve moving mechanism 27 housed inside the head cover 16. An upstream side of the intake manifold 22 is disposed in front of the crankcase 14, connected to a throttle valve 29 fixed to a front surface, and supplied with intake air through a silencer 28. Injectors 58 for injecting a fuel into the intake ports 21 are provided at an injector base 57 sandwiched between the cylinder head 15 and the intake manifold 22.

A chain cover 31 housing a timing chain (not shown) that transmits a driving force of the crankshaft 13 to the valve moving mechanism 27 is connected to upper portions of the cylinder block 11, the lower block 12, the crankcase 14, and the cylinder head 15 of the engine E. An oil pump body 34 is connected to lower surfaces of the cylinder block 11, the lower block 12, and the crankcase 14. A mount case 35, an oil case 36, an extension case 37, and a gear case 38 are sequentially connected to a lower surface of the oil pump body 34.

The oil pump body 34 houses an oil pump 33 between a lower surface of the oil pump body 34 and an upper surface of the mount case 35. On the opposite side, a flywheel 32 is disposed between the oil pump body 34 and a lower surface of the cylinder block 11, and the like. A flywheel chamber and an oil pump chamber are defined by the oil pump body 34. The oil case 36, the mount case 35, and a periphery of a part of a lower side of the engine E are covered with an undercover 39 made of a synthetic resin. An upper part of the engine E is covered with an engine cover 40 made of a synthetic resin connected to an upper surface of the undercover 39.

A drive shaft 41 connected to a lower end of the crankshaft 13 penetrates through the pump body 34, the mount case 35, and the oil case 36, extends downward inside the extension case 37, and is connected to a front end of a propeller shaft 44. The shaft 44 includes a propeller 43 at a rear end and is supported at a gear case 38 in a longitudinal direction via a forward and reverse travel switching mechanism 45 which is operated by a shift rod 52. A lower water supply passage 48, which extends upward from a strainer 47 provided at the gear case 38, is connected to a cooling water pump 46 provided at the drive shaft 41. An upper water supply pipe 49, which extends upward from the water cooling pump 46, is connected to a cooling water supply passage 36*b* (see FIG. 7) provided in the oil case 36.

Next, a structure of an exhaust system and a cooling system of the engine E will be explained based on FIG. 2 to FIG. 7.

The exhaust passage means of the engine E is broadly divided into an exhaust passage 24 portion in an engine room and an exhaust chamber portion divided from the engine room. The exhaust passage 24 in the engine room includes: an exhaust manifold 61 including single pipe portions 61*a*, which are connected to a right side surface of the cylinder head 15 and introduce exhaust gas from each of the combustion chambers 20; a collecting part 61*b* in which these single pipe portions 61*a* are collected at the downstream regions of the single pipe portions 61*a*; and an exhaust guide 62 for guiding the exhaust gas to the outside of the engine room.

The exhaust guide 62 is connected to the upper surface of the mount case 35 which forms a partition wall of the engine room and communicates with an exhaust passage 35*b* penetrating through the mount case 35. The exhaust passage 35*b* communicates with an exhaust chamber 63 (see FIG. 7) in the extension case 37 via an exhaust pipe portion 36*c* integrally formed with the oil case 36.

The exhaust manifold 61 includes a plurality, e.g., four, single pipe portions 61*a*, communicating with a corresponding number of exhaust ports 23, and the collecting part 61*b* where the single pipe portions 61*a* are integrally collected. The collecting part 61*b* extends in a direction away from the cylinder block 11 and is disposed along the cylinder head 15 and the head cover 16. The exhaust guide 62 is curved into an S-shape, and a lower end portion of the exhaust manifold 61 is fitted to an inner periphery of a connecting portion 62*a* having a large diameter at an upper end of the exhaust guide 62.

A first exhaust guide cooling water jacket JM1, covering half of the periphery of an upper surface side of the exhaust guide 62, and a second exhaust guide cooling water jacket JM3, covering half of the periphery of a lower surface side of the exhaust guide 62, surround the exhaust passage 62*d*. An exhaust manifold cooling water jacket JM2 surrounds a periphery of the exhaust manifold 61. When the lower end of the exhaust manifold 61 is fitted to an inner periphery of the connecting portion 62*a* of the exhaust guide 62, the exhaust manifold cooling water jacket JM2 of the exhaust manifold 61 and the first exhaust guide cooling water jacket JM1 of the exhaust guide 62 communicate with each other.

The first exhaust guide cooling water jacket JM1 communicates with a cooling water supply hose 112 (described below) via an unillustrated connecting hole 62*e* and a connecting hose, and supplies and discharges the cooling water when the engine stops.

Figure 5:
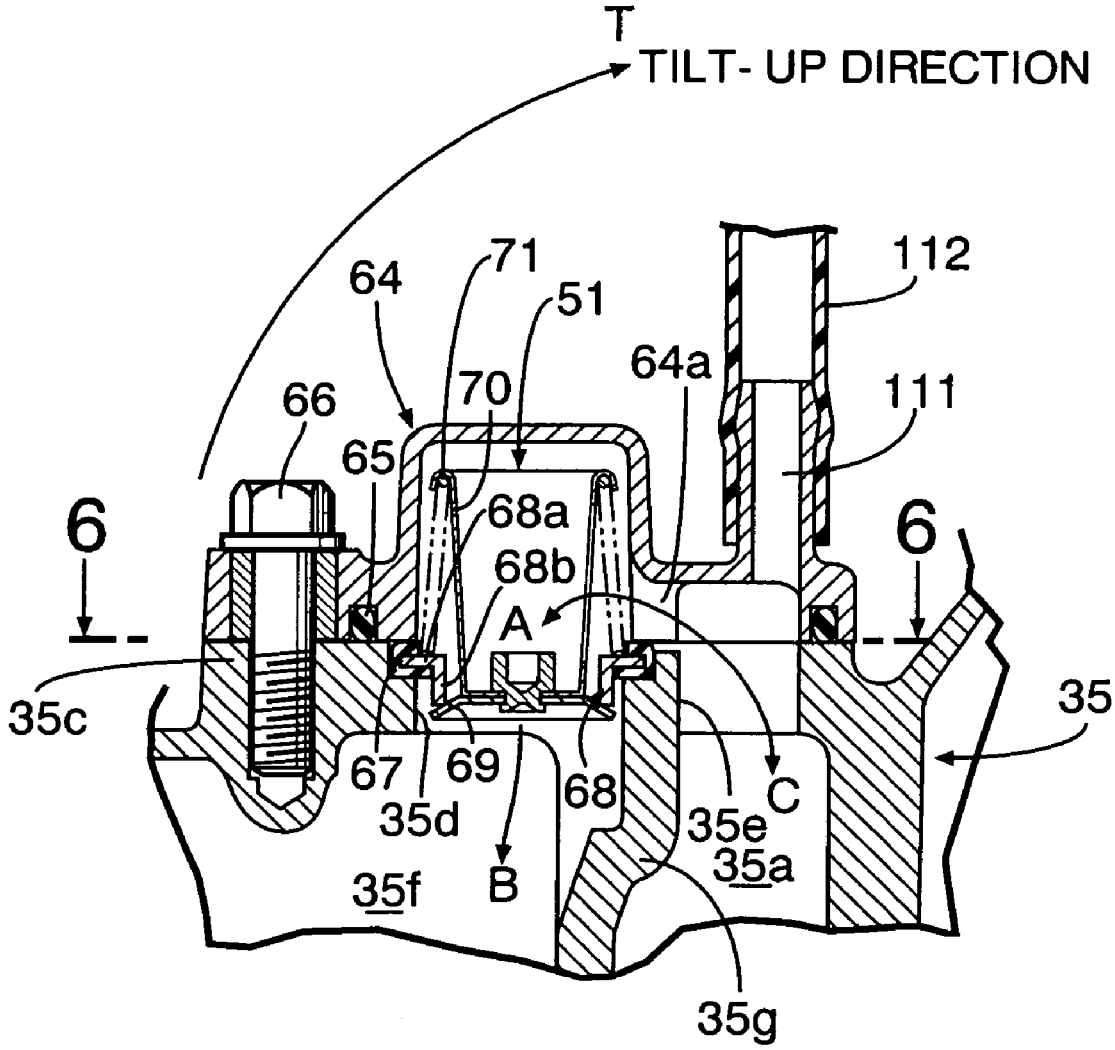
FIG. 5 is an enlarged cross-sectional view of an essential part in FIG. 3.
Figure 6:
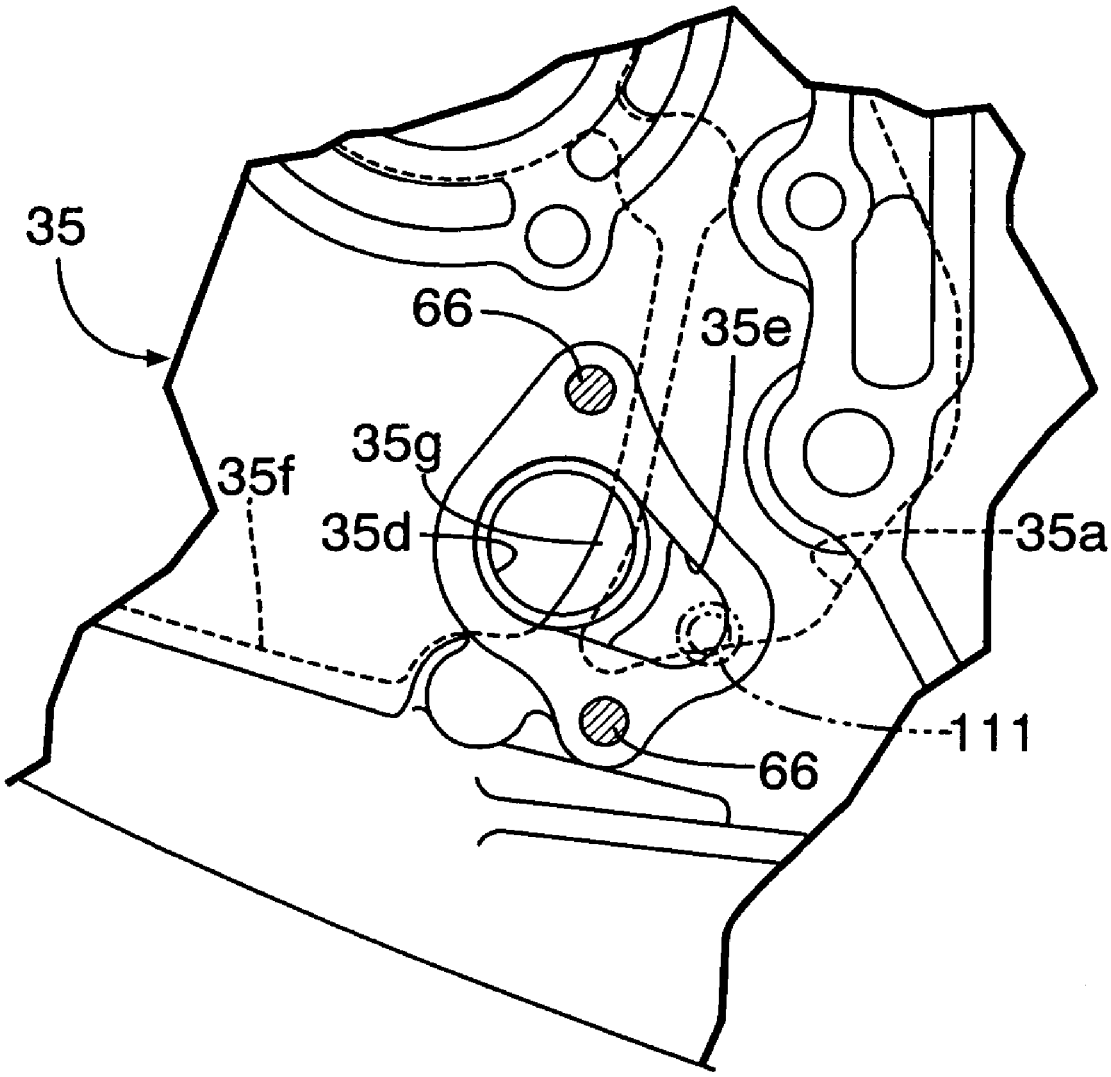
FIG. 6 is a view taken from the arrows of line 6—6 in FIG. 5.

As shown in FIG. 5 and FIG. 6, a first opening 35*d* and a second opening 35*e* are formed adjacent to each other in an upper wall 35*c* of the mount case 35. The first opening 35*d* communicates with the exhaust chamber 63 via the oil case 36 from a cooling water discharge passage 35*f* situated below the first opening 35*d*. The second opening 35*e* communicates with the cooling water supply passage 35*a*. The cooling water supply passage 35*a* and the cooling water discharge passage 35*f* are partitioned by a partition wall 35*g*. A cover member 64 is fixed to the upper wall 35*c* of the mount case 35 via a seal member 65 with two bolts 66 and 66 to cover the first opening 35*d* and the second opening 35*e*. A pressure regulating passage 64*a*, connecting the cooling water supply passage 35*a* and the cooling water discharge passage 35*f*, is formed inside the cover member 64.

The relief valve 51, disposed in the first opening 35*d* of the upper wall 35*c* of the mount case 35 and the cover member 64, includes a valve seat 68 supported by the first opening 35*d*, wherein the valve seat 68 includes an annular flange portion 68*a* mounted to the first opening 35*d* via a seal member 67, and a cylindrical seat portion 68*b* protruding downward from the periphery of the flange portion 68*a*. A plate-shaped valve body 69 seated from below at a lower end of the seat portion 68*b* of the valve seat 68 includes a spring seat 70 passing through the first opening 35*d* to protrude into the cover member 64. The valve body 69 is biased upward to the valve seat 68 by an elastic force of a valve spring 71 disposed between an upper end of the spring seat 70 and an upper surface of an outer periphery portion of the valve seat 68. The second opening 35*e* is disposed at a side closer to a tilt shaft 97 (see FIG. 1) than the first opening 35*d*. Therefore, when the outboard engine system O is tilted upward in the direction of the arrow T in FIG. 5, the position of the first opening 35*d* is displaced to be higher than the position of the second opening 35*e*.

Figure 4:
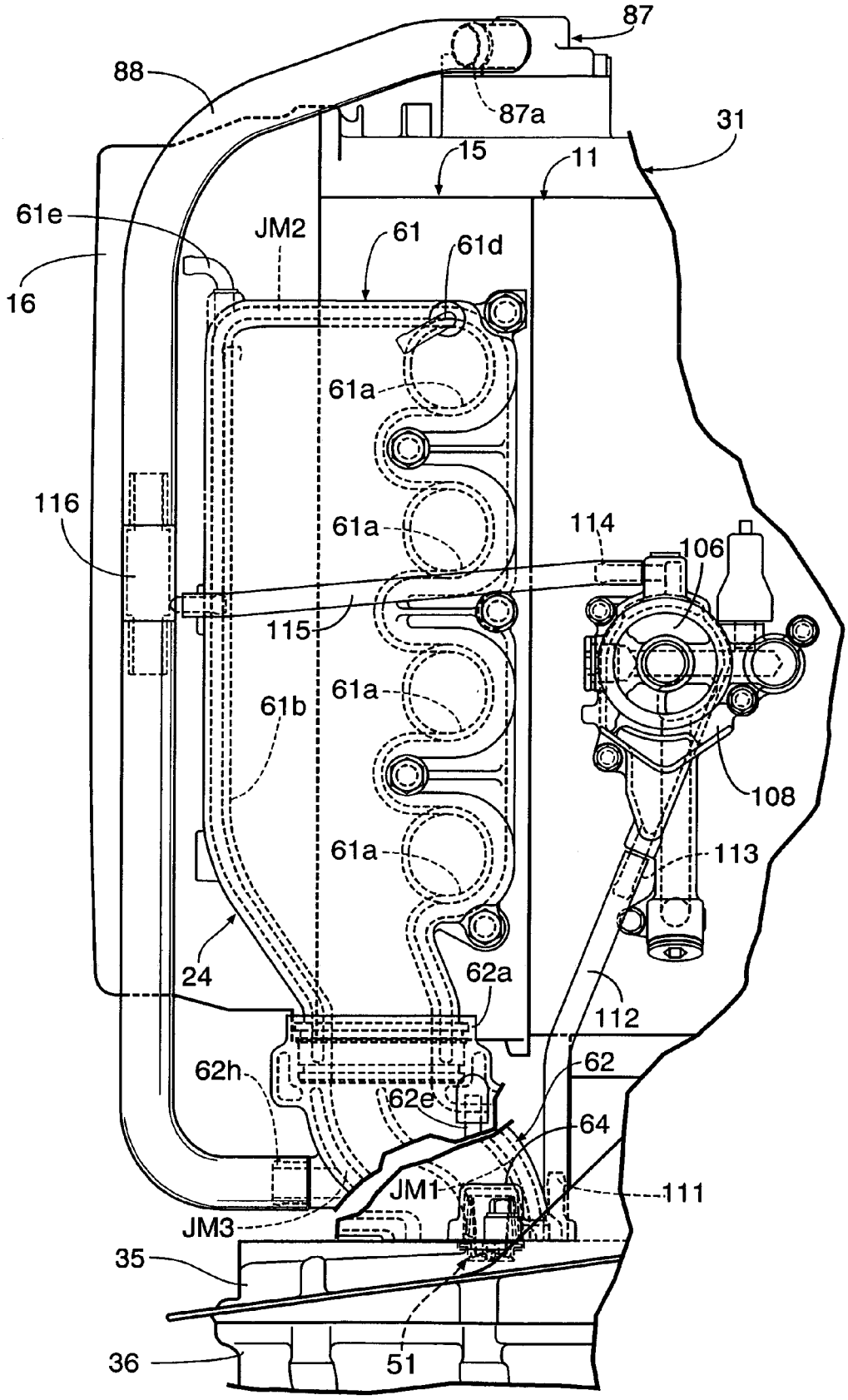
FIG. 4 is a view taken from the direction of arrow 4 in FIG. 3.

As shown in FIG. 4, a cooling water supply hose 112 extending from a joint 111 provided at the cover 64 is connected to a joint 113 at a lower end of a base member 108 of the oil filter 106. A cooling water discharge hose 115, extending from a joint 114 provided at an upper end of the base member 108, is connected to a joint 116 provided at an intermediate portion of a discharge pipe 88.

Figure 7:
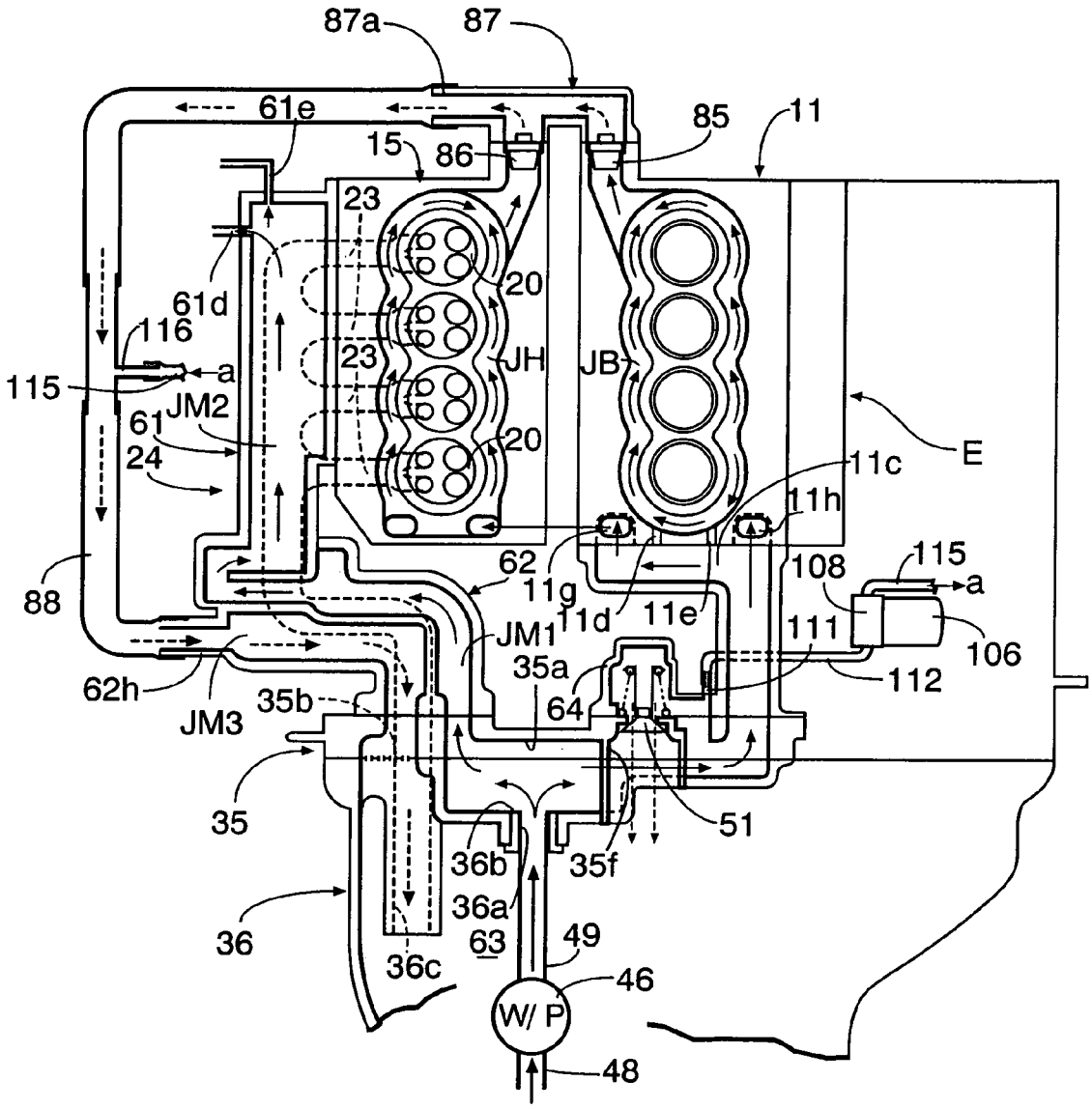
FIG. 7 is a schematic diagram of the flow of cooling water through an engine cooling system according to the embodiment of the present invention.

Next, referring mainly to FIG. 7, showing the flow path of the cooling water, a structure and an operation regarding cooling of the entire engine E will be explained.

When the drive shaft 41 connected to the crankshaft 13 is rotated by operation of the engine E, the cooling pump 46 provided at the drive shaft 41 is operated to supply the cooling water, which is drawn up through the strainer 47, to the cooling water supply port 36*a* at a lower surface of the oil case 36 via the lower water supply passage 48 and the upper water supply pipe 49. The cooling water, which passes through the cooling water supply port 36*a*, flows into the cooling water supply passage 36*b* of the oil case 36 and the cooling water supply passage 35*a* of the mount case 35. Part of the cooling water branching from the cooling water supply passage 36*b* and the cooling water supply passage 35*a* is supplied to the first exhaust guide cooling water jacket JM1 formed in the exhaust guide 62 of the exhaust passage 24 in the engine room and the exhaust manifold cooling water jacket JM2 formed in the exhaust manifold 61. The exhaust gas, which is discharged from the combustion chambers 20 of the cylinder head 15, is discharged to the exhaust chamber 63 via the single pipe portions 61*a* and the collecting portion 61*b* of the exhaust manifold 61, the exhaust passage 62*d* of the exhaust guide 62, the exhaust passage 35*b* of the mount case 35, and the exhaust pipe portion 36*c* of the oil case 36. During this process, the exhaust passage 24 in the engine room, which assumes a high temperature due to the exhaust gas, is cooled by the cooling water flowing through the first exhaust guide cooling water jacket JM1 and the exhaust manifold cooling water jacket JM2.

The cooling water flowing upward through the first exhaust guide cooling water jacket JM1 and the exhaust manifold cooling water jacket JM2 assumes a raised temperature and is discharged from the joints 61*d* and 61*e* provided at the upper end of the exhaust manifold 61 through a pipe (not shown), or the like, into the exhaust chamber 63.

Meanwhile, a part of the cooling water having a low temperature, which is supplied to the cooling water supply passages 36*b* and 35*a* leading to the cooling water supply port 36*a*, flows into a lower end of a cylinder block cooling water jacket JB via two through-holes 11*d* and 11*e* opened to a cooling water supply passage 11*c* at the lower end of the cylinder block 11. A part of the cooling water having a low temperature, which is supplied into the cooling water supply passages 36*b* and 35*a*, flows from the cooling water supply passage 11*c* at the lower end of the cylinder block 11 through two cooling water supply passages 11*g* and 11*h* into a lower end of a cylinder head cooling water jacket JH.

During warming-up of the engine E, valves of a first thermostat 85, connected to the upper end of the cylinder block cooling water jacket JB, and a second thermostat 86, connected to the upper end of the cylinder head cooling water jacket JH, are closed. The cooling water in the cylinder block cooling water jacket JB and the cylinder head cooling water jacket JH remains without flowing, thus promoting warming-up of the engine E. In this case, the cooling water pump 46 continues to rotate, but the cooling water leaks from the periphery of the rubber impeller, wherein the cooling water pump 46 is substantially in an idling state.

When warming-up of the engine E is completed and the temperature of the cooling water rises, the valves of the first and the second thermostats 85 and 86 open, and the cooling water in the cylinder block cooling water jacket JB and the cooling water in the cylinder head cooling water jacket JH flow from a common joint 87*a* of a thermostat cover 87, through an exhaust pipe 88 and the joint 62*h* of the exhaust guide 62, into the second exhaust guide cooling water jacket JM3. The cooling water, which cools the exhaust guide 62 while flowing through the second exhaust guide cooling water jacket JM3, passes downward through the mount case 35 and the oil case 36 and is discharged into the exhaust chamber 63.

The cooling water, which branches into the cooling water supply hose 112 from the joint 111 of the cover member 64 of the relief valve 51, flows inside the water jacket of the base member 108 of the oil filter 106, and cooling water, which cools oil to assume a raised temperature, is discharged into the intermediate portion of the exhaust pipe 88 via the cooling water discharge hose 115.

When the rotational speed of the engine E increases, and the water pressure of the cooling water supply passage 35*a* of the mount case 35 is at a predetermined value or more, the water pressure acts on the relief valve 51 provided at the first opening 35*d* via the second opening 35*e* and the pressure regulating passage 64*a* of the cover member 64, so that the valve body 69, which is pushed down against the elastic force of the valve spring 71, is separated from the valve seat 68 and the relief valve 51 opens. As a result, as shown by the arrows A and B in FIG. 5, the cooling water, which passes through the relief valve 51, is discharged into the exhaust chamber 63 via the cooling water discharge passage 35*f*.

When the rotational speed of the engine E decreases, or when the engine E stops, the water pressure of the cooling water supply passage 35*a* becomes less than the predetermined value and the relief valve 51 closes. When the engine E stops, the cooling water pump 46 also stops and supply of the cooling water is not performed. Therefore, the cooling water staying in the pressure regulating passage 64*a* inside the cover member 64 flows down to the cooling water supply passage 35*a* through the second opening 35*e* via gravity, and is leaked through the gap of the impeller of the cooling water pump 46 to be discharged. In this case, the cooling water remaining in a recess surrounded by the valve seat 68 and the valve body 69 of the relief valve 51 is leaked through the gaps between the valve seat 68 and the valve body 69 little by little to be discharged.

In addition, the valve seat 68 of the relief valve 51 includes the annular flange portion 68*a* mounted to the first opening 35*d*, and the cylindrical seat portion 68*b* protruding downward from an inner periphery of the flange portion 68*a*. Therefore, a recessed portion is prevented from being formed between the flange portion 68*a* and the seat portion 68*b*, wherein the water is unable to remain.

On the other hand, in the conventional relief valve in which the valve body is seated on the valve seat from above, the valve seat protrudes upward to the valve body, which is seated from above, and therefore, a recess is formed around the valve seat, and the cooling water staying in the recessed portion is not able to be discharged for a long time.

When the outboard engine system O is tilted upward about the tilt shaft 97 (see FIG. 1) to land the outboard engine system O, the relief valve 51 tilts upward in the direction of the arrow T in FIG. 5. As a result, the position of the first opening 35*d* provided with the relief valve 51 becomes higher than the position of the second opening 35*e*, which is not provided with the relief valve 51, and the cooling water staying in the upper portion of the relief valve 51 is forcibly discharged from the pressure regulating passage 64*a* inside the cover member 64 through the second opening 35*e* into the cooling water supply passage 35*a*, as shown by the arrow C. If the relief valve 51 was provided in the second opening 35*e*, the cooling water of the pressure regulating passage 64*a* would be moved to the side of the relief valve 51 by tilting the outboard engine system O upward, that is, the cooling water would not be prevented from staying.

The cover member 64 is fixed to the upper surface of the mount case 35 with the bolts 66 and 66 to form the pressure regulating passage 64*a*, and an upper half portion of the relief valve 51 is housed therein, thus contributing to making the mount case 35 compact and light as compared with the case where the entire pressure regulating passage 64*a* and the relief valve 51 are provided inside the mount case 35.

Although an embodiment of the present invention has been described above, various changes in design can be made within the scope of the present invention.

For example, the second feature of the invention is applicable to an outboard engine system in which the cooling water supply passage 35*a* is provided as a cooling water exhaust passage, the cooling water discharge passage 35*f* is provided as a cooling water supply passage, and the valve body 69 may be seated from above the valve seat 68.

What is claimed is:

1. An outboard engine system in which cooling water is supplied from a cooling water pump through a cooling water supply passage to a water jacket provided around a combustion chamber of an engine, wherein internal pressure of the cooling water supply passage is regulated by a relief valve, wherein the relief valve comprises: a valve seat having a flange portion mounted to a substantially horizontal upper wall and a cylindrical seat portion protruding downward from the flange portion; a valve body seated on the seat portion of the valve seat from below; and a valve spring disposed on an upper surface of the flange portion and which biases the valve body upward toward the valve seat.

2. An outboard engine system in which cooling water is supplied from a cooling water pump through a cooling water supply passage to a water jacket provided around a combustion chamber of an engine tiltably mounted around a tilt shaft, the cooling water of the cooling water supply passage being discharged through a relief valve into a cooling water discharge passage, wherein a first opening communicating with the cooling water discharge passage and a second opening communicating with the cooling water supply passage are formed adjacent to each other in an upper wall of a cooling water passage forming member, wherein a pressure regulating passage is formed by covering upper portions of the first and the second openings with a cover member, wherein the relief valve includes: a valve seat having a flange portion and a seat portion extending orthogonally from an end of the flange portion; a valve body seated on a free end of the seat portion; a valve spring disposed on an upper surface of the flange portion, wherein the relief valve is provided in one of the first and the second openings, and wherein the other opening of the first and second openings is disposed closer to a tilt shaft than the opening provided with the relief valve.

3. The outboard engine system according to claim 2, wherein at least a part of the relief valve is housed inside the cover member.

4. The outboard engine system according to claim 1, wherein the relief valve is interposed between the cooling water supply passage and a cooling water discharge passage located below the relief passage, and the cylindrical seat portion of the valve seat protrudes toward the cooling water discharge passage.

5. The outboard engine system according to claim 2, wherein the seat portion is cylindrical and protrudes toward the cooling water discharge passage.

* * * * *